US007188826B1

(12) United States Patent
Gibbs

(10) Patent No.: US 7,188,826 B1
(45) Date of Patent: Mar. 13, 2007

(54) INTERNAL CLIP FOR A RAIL

(76) Inventor: Edward L. Gibbs, 1555 N. Mingo Rd., Tulsa, OK (US) 74116

( * ) Notice: Subject to any disclaimer, the term of this patent is extended or adjusted under 35 U.S.C. 154(b) by 0 days.

(21) Appl. No.: 10/904,649

(22) Filed: Nov. 20, 2004

(51) Int. Cl.
*E04H 17/14* (2006.01)

(52) U.S. Cl. ..... 256/22

(58) Field of Classification Search ..... 256/32, 256/47, 54, 56, 57, 59, 62, 68, 71, 22, 70, 256/1, 13.1, 10, DIG. 3
See application file for complete search history.

(56) References Cited

U.S. PATENT DOCUMENTS 3,397,866 A * 8/1968 Hockett ..... 256/22
3,481,094 A * 12/1969 Taylor ..... 52/394
4,964,618 A * 10/1990 Kennedy et al. ..... 256/24
6,969,051 B1 * 11/2005 Gibbs ..... 256/65.01
2003/0164484 A1 * 9/2003 Deeley ..... 256/22
2003/0193047 A1 * 10/2003 Wiley ..... 256/59

OTHER PUBLICATIONS

Ameristar Fence Products, Inc., Impasse brochure, published in USA, Aug. 2002, pp. 1-12.

* cited by examiner

*Primary Examiner*—Daniel P. Stodola
*Assistant Examiner*—Joshua T. Kennedy
(74) *Attorney, Agent, or Firm*—Gary Peterson

(57) ABSTRACT

A resilient clip adapted for internal installation within a rail having a longitudinally extending internal gap. The clip includes a lower leg that engages the base of the rail, and an intermediate leg, which engages a side wall of the rail. An indented upper leg of the clip is capable of clamping an elongate line, such as an electrical or communication line, in an elevated position in the upper section of the rail. Plural clips may be installed in the rail to support such a line at multiple spaced points along its length. A strengthening cable may be installed in the lower section of the rail, in overlying relationship to the lower legs of the clips.

22 Claims, 4 Drawing Sheets

INTERNAL CLIP FOR A RAIL

FIELD OF THE INVENTION

The present invention relates generally to holding devices, such as clips, and more particularly to a clip for an elongate line, which extends within the rail of a barrier, such as a fence.

SUMMARY OF THE INVENTION

The present invention comprises a clip adapted for installation within an elongate rail having a pair of elongate edge portions defining the boundaries of a longitudinal gap. The clip has opposed interior and exterior surfaces, and further comprises a lower leg, an intermediate leg, which adjoins the lower leg, and an upper leg, which adjoins the intermediate leg. The upper leg is characterized by a transverse indentation formed in its exterior surface.

The present invention also comprises a clip adapted for internal installation within a rail having a pair of elongate edge portions defining the boundaries of a longitudinal gap. The rail is characterized a lower section which includes one of the edge portions and comprises a side wall situated opposite the gap, a lip disposed in spaced and opposed relationship to the side wall, and a base which interconnects the lip and the side wall. The rail is further characterized by an upper section, which includes the other edge portion, and comprises an upper wall joining the side wall. The clip is characterized by opposed interior and exterior surfaces, and further comprises a lower leg engagable with the base section of the rail. An intermediate leg adjoining the lower leg is engagable with the side wall of the rail, and an upper leg adjoining the intermediate leg is engagable with the upper wall of the rail. A transverse indentation formed in the exterior surface of the upper leg.

BRIEF DESCRIPTION OF THE DRAWINGS

FIG. 5 is an enlarged and detailed front elevational view of a portion of the barrier shown in FIG. 4.

DETAILED DESCRIPTION

Figure 1:
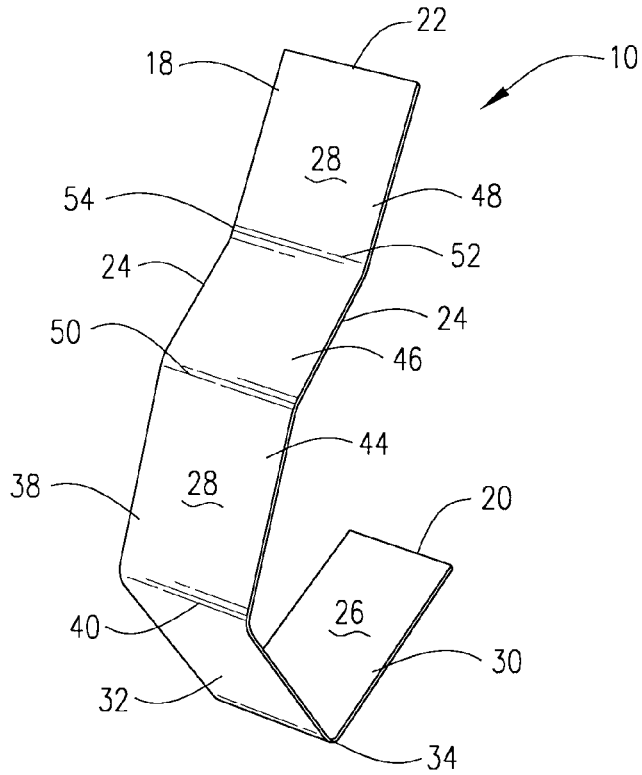
FIG. 1 is a perspective view of the clip of the present invention.
Figure 3:
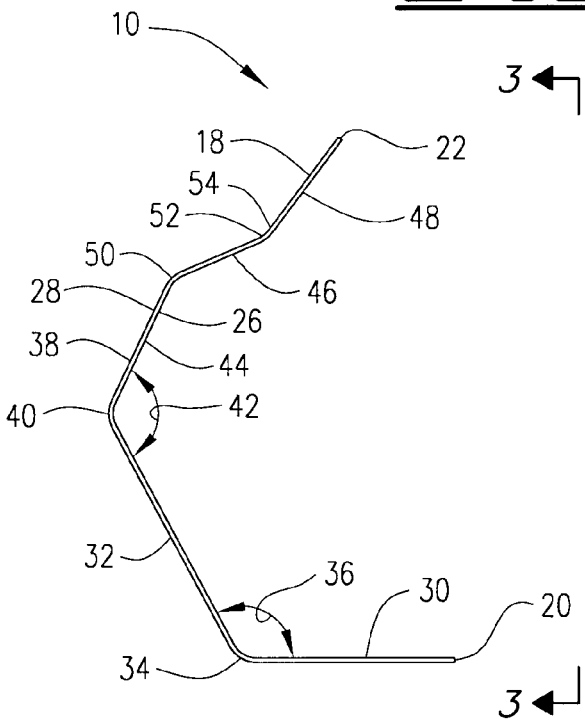
FIG. 3 is a side elevational view of the clip shown in FIG. 2, taken along line 3—3.
Figure 2:
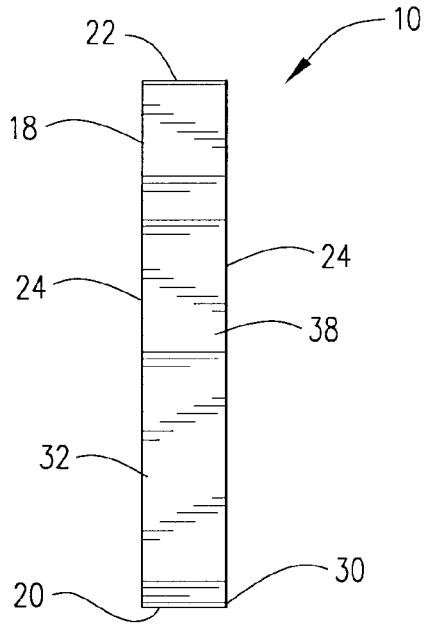
FIG. 2 is an end view of the clip of the present invention.
Figure 4:
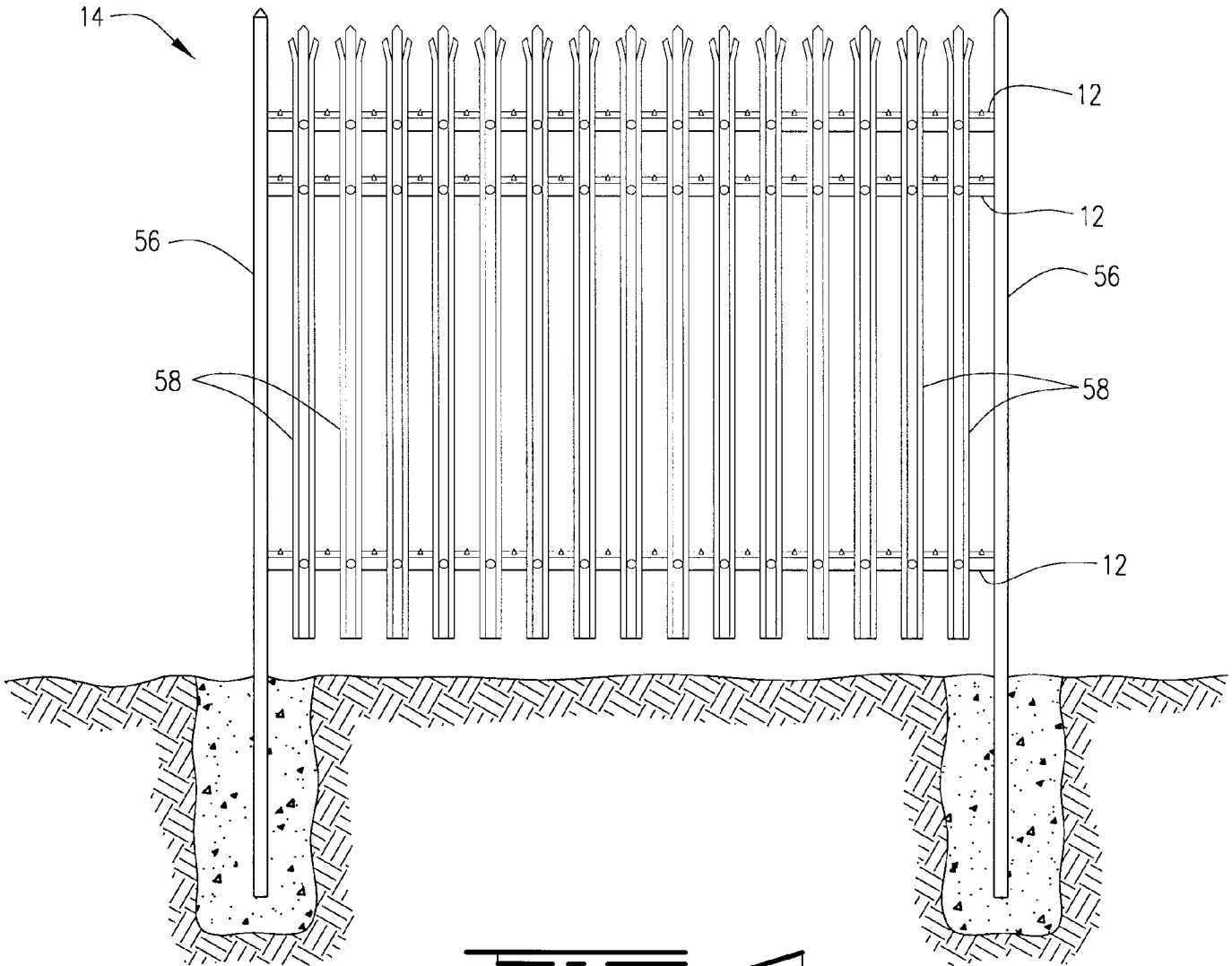
FIG. 4 is a front elevational view of a barrier in which clips of the present invention have been installed. The terrain and substrate supporting the barrier are shown in cross section.
Figure 3:
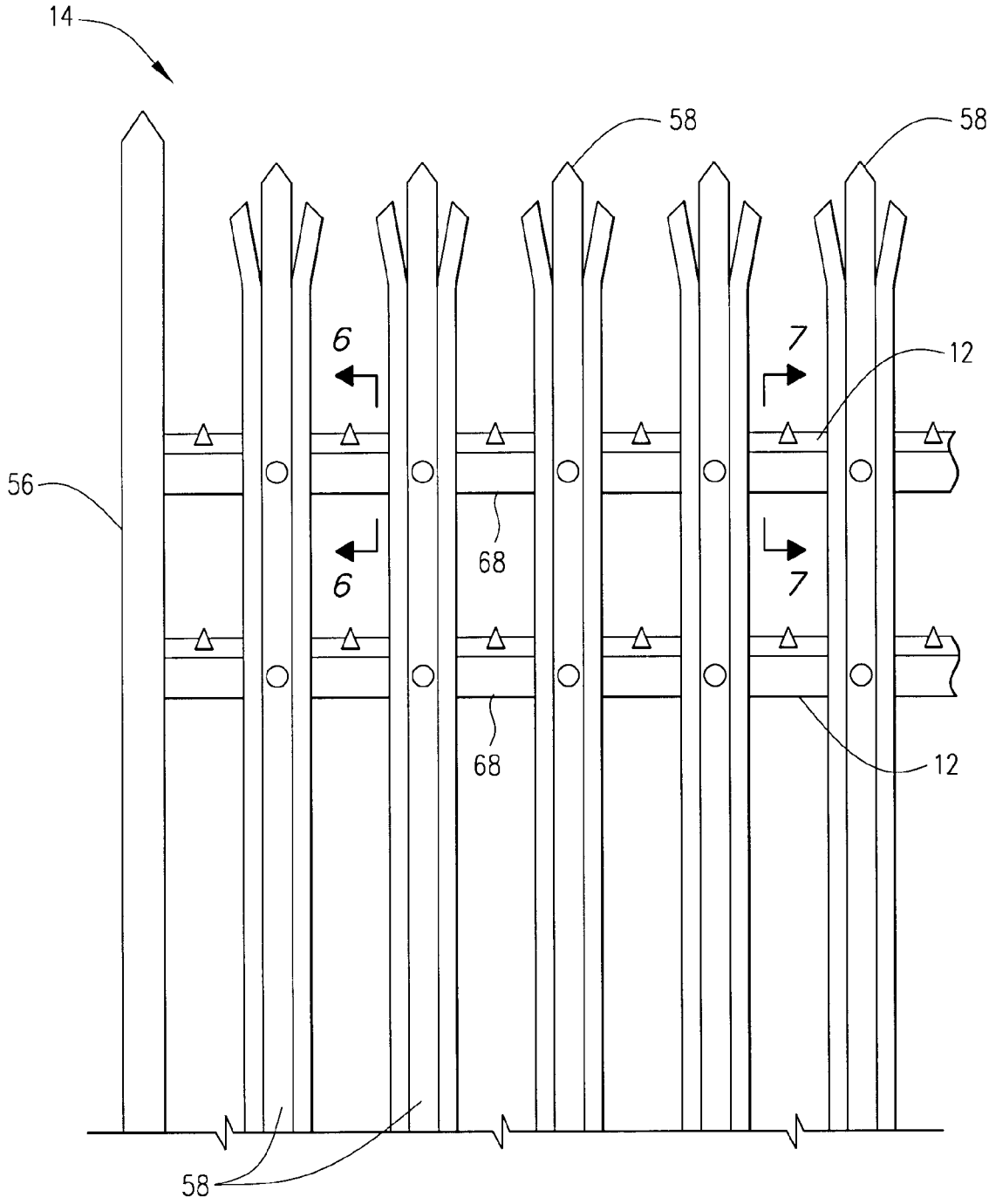

The present invention comprises a clip, shown in FIGS. 1–3 and generally designated by reference numeral 10, which is adapted for internal installation within an elongate rail 12, shown in FIGS. 4–7. The rail 12 preferably comprises a structural component of a barrier 14, such as a fence, balustrade, or gate. In the embodiment shown in the figures, the barrier 14 comprises a fence, one panel of which is shown in FIGS. 4 and 5.

The barrier 14 preferably comprises a plurality of rails 12 disposed in spaced and parallel relationship. The rails 12 are supported at opposite ends by a pair of posts 56, each of which is supported by a substrate, such as the ground or an underground mass of concrete. The barrier 14 further comprises a plurality of upright members 58, such as pickets, with each upright member 58 extending in transverse relationship to the rails 12, and supported thereby. Rails and barriers suitable for practice of the present invention are disclosed in U.S. patent application Ser. No. 10/306,125, filed Nov. 27, 2002, now U.S. Pat. No. 6,874,767, the entire disclosure of which is incorporated by reference.

With reference to FIGS. 1–3, the clip 10 is formed from a strong, durable and resilient material, such as an elongate rectangular strip 18 of stainless coil steel. The strip 18 is characterized by a first end 20 and an opposed second end 22, a pair of spaced lateral edges 24, an interior surface 26, which is generally concave, and by an opposed exterior surface 28, which is generally convex. Preferably, the strip 18 has a length of about 4.6 inches and a width of about 0.5 inches.

The clip 10 preferably comprises a plurality of integral legs. A lower leg 30, preferably planar and rectangular in shape, includes the first end 20 of clip 10. An intermediate leg 32, also preferably planar and rectangular in shape, adjoins the lower leg 30, and is situated at a position between the lower leg 30 and second end 22. The junction 34 between the lower leg 30 and intermediate leg 32 preferably comprises a transverse bend formed in strip 18. As shown in FIG. 2, the interior surfaces of the lower and intermediate legs 30 and 32 define an included angle 36 at junction 34, which is preferably greater than 90 degrees.

The clip 10 further comprises an upper leg 38, which adjoins the intermediate leg 32, and is situated at a position between the intermediate leg 32 and second end 22. Preferably, the upper leg 38 includes the second end 22 of strip. The junction 40 between the intermediate leg 32 and upper leg 38 preferably comprises a transverse bend formed in strip 18. As shown in FIG. 2, the interior surfaces of the intermediate and upper legs 32 and 38 define an included angle 42 at junction 40, which is preferably greater than 90 degrees.

In the embodiment shown in FIGS. 1–3, the upper leg 30 is characterized by a zigzag profile and is formed from a first upper panel 44, a second upper panel 46, and a third upper panel 48. Each of the upper panels 44, 46 and 48 is preferably rectangular and planar. The first and second upper panels 44 and 46 are joined by a convex bend 50 in the exterior surface 28, while the second and third upper panels 46 and 48 are joined by a concave bend 52 in the exterior surface 28. The junction 40 between the upper leg 38 and intermediate leg 32 preferably comprises an end of the first upper panel 44. The end of third upper panel 48 situated opposite bend 52 preferably coincides with the second end 22 of strip 18. The zigzag profile of the upper leg 38 produces a transverse indentation 54 in the exterior surface 28 of upper leg 38, characterized by an included angle greater than 90 degrees.

Figure 6:
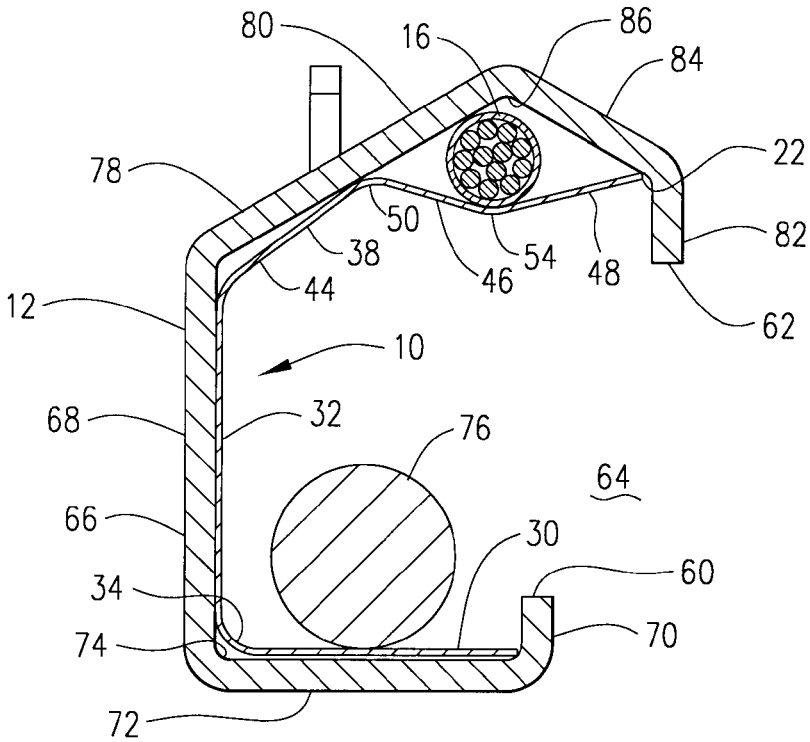
FIG. 6 is a cross sectional view of a rail of the barrier shown in FIG. 5, taken along line 6—6.
Figure 7:
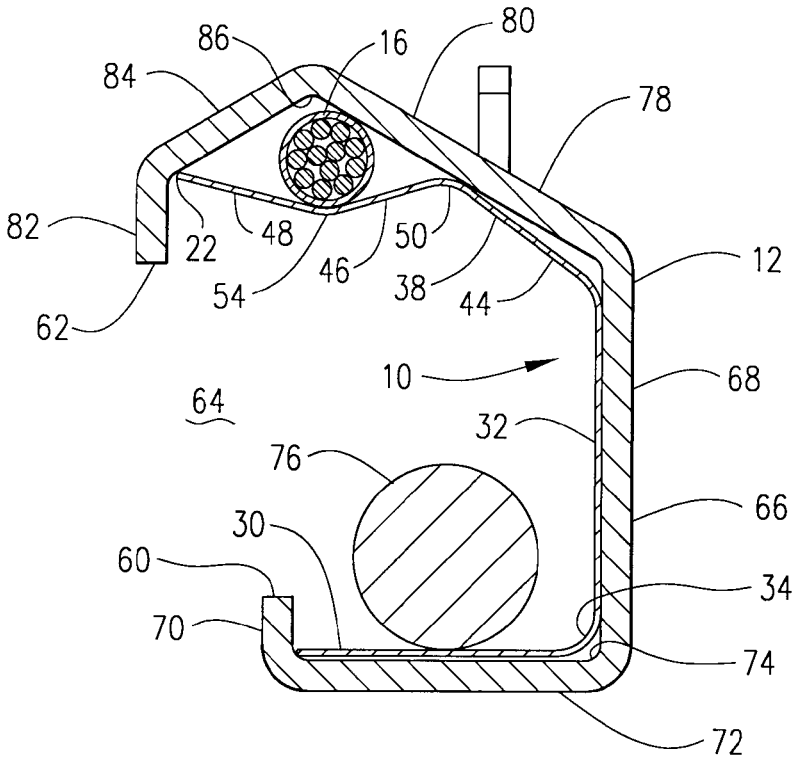
FIG. 7 is a cross sectional view of a rail of the barrier shown in FIG. 5, taken along line 7—7.

With reference to FIGS. 5–7, the clip 10 is adapted for internal installation within a rail 12 having a pair of elongate edge portions 60 and 62 defining the boundaries of a longitudinal gap 64. The rail 12 is characterized by a lower section 66 which includes one of the edge portions 60, comprising a side wall 68 situated opposite the gap 64, and a first lip 70 situated immediately adjacent the longitudinal edge of the rail 12, in spaced and opposed relationship to the side wall 68. The lower section 66 further comprises a base 72, which interconnects the first lip 70 and the side wall 68. The base 72, first lip 70 and side wall 68 cooperate to define an internal tray 74 within which a strengthening cable 74 may be extended. Preferably the first lip 70 and side wall 68 are parallel, and extend in perpendicular relationship to the base 72.

The rail 12 further comprises an upper section 78, which includes the other edge portion 64. The upper section 78 preferably comprises an upper front wall 80 that joins the side wall 68, and a second lip 82 situated immediately adjacent the longitudinal edge of the rail 12, preferably in parallel relationship to the first lip 70. The upper section 78 further comprises an upper rear wall 84, which interconnects the second lip 82 and upper front wall 80. The upper front wall 80 and upper rear wall 84 preferably extend in angled relationship, to define an internal indentation 86 in the upper section 78. The included internal angle between the upper front and rear walls 82 and 84 is preferably approximately equal to the included angle defined by indentation 54 in the exterior surface 28 of upper leg 38.

The clip 10 is installed internally within the rail 12, preferably by insertion through the gap 64. In order to facilitate this insertion, the width of the strip 18 forming the clip 10 should be less than the width of the gap 64. As shown in FIGS. 6 and 7, the lower leg 30 of clip 10 is engagable with the base section 72 of the rail 12. Preferably, the lower leg 30 is sized to be closely but clearingly receivable between the side wall 68 and the first lip section 70, and disposable in a flush relationship to the base section 72. In its installed position, lower leg 30 is flush with base section 72, and in underlying relation to any strengthening cable 76 installed within the internal tray 74. The respective opposite ends of installed lower leg 30 are either in contact with, or closely adjacent the first lip 70 and side wall 68.

With continued reference to FIGS. 6 and 7, the intermediate leg 32 of clip 10 is sized to be engagable with the side wall 68 of the rail 12, preferably in flush relationship thereto. Preferably, the length of intermediate leg 32 is no greater than, and approximately equal to the length of side wall 68. The internal angle 36 between the lower and intermediate legs 30 and 32 of clip 10 is preferably greater than the internal angle defined by the base section 72 and side wall 68. Because of the resiliency of strip 18, the clip 10 may be compressed to conform to the internal angle between the base section 72 and side wall 68, as shown in FIGS. 6 and 7. This compression promotes the clamping action of the clip 10. In its installed position, intermediate leg 32 is flush with side wall 68.

The upper leg 38 is sized to be engagable with upper front wall 80 of the rail 12, preferably at or adjacent bend 50. In an installed position of clip 10, first upper panel 44 preferably extends in contact with, or is closely adjacent, upper front wall 80. The upper leg 38 is also sized to contact, and in its installed position contacts, the junction of second lip 82 and rear front wall 84 at its second end 22. In the installed position of clip 10, shown in FIGS. 6 and 7, the indentation 54 is spaced from the corresponding indentation 86 formed in the upper section 78 of the rail 12.

In its installed position, the clip 10 is adapted to securely support a line 16, such as an elongate communication line or power line, in a position between the indentation 54 and the upper section 78 of rail 12. The compression of clip 10 adjacent junction 34 produces a clamping action by the upper leg 38 against the internal surface of rail 12. This clamping action functions to maintain a supported line in an elevated position within the rail 12, against the indentation 86.

Preferably, a plurality of clips 10 are internally installed at longitudinally spaced positions along the rail 12, with the same line 16 traversing the indentation formed in each clip 10. These plural spaced clips 10 support the line 16 at multiple spaced points along its length, thereby maintaining the line 16 in an elevated position adjacent the indentation 86 in upper section 78 within rail 12. Placement of the line 16 in this relatively inaccessible position enhances its security against tampering, and protects the line 10 from becoming entangled or damaged by cable 76. At the same time, because the lower and intermediate legs 30 and 32 of the installed clips 10 are flush with base 72 and side wall 68 of the rail 12, the clips 10 do not interfere with installation and positioning of the strengthening cable 76 within internal tray 74.

Changes may be made in the construction, operation and arrangement of the various parts, elements, steps and procedures described herein without departing from the spirit and scope of the invention as described in the following claims.

What is claimed is:

1. A system, comprising:

an elongate first rail having inner surfaces defining an internal region;

a plurality of clips disposed in longitudinally spaced relationship in the internal region of the first rail, each clip having opposed interior and exterior surfaces and comprising:

a lower leg;

an intermediate leg that adjoins the lower leg; and an upper leg that adjoins the intermediate leg and is characterized by a transverse indentation formed in the exterior surface thereof; and an elongate conductive line, distinct from the first rail, extending within the internal region of the first rail;

in which the line traverses the indentation formed in each clip and in which each clip clamps the line against an inner surface of the first rail.

2. The system of claim 1 in which the clip is formed from a resilient material.

3. The system of claim 2 in which the interior surfaces of the intermediate and upper legs define an included angle greater than 90 degrees.

4. The system of claim 1 in which the width of the clip is less than the width of the gap formed in the first rail.

5. A barrier comprising the system of claim 1, and further comprising:

at least one additional rail disposed in spaced and parallel relationship to the first rail; and a plurality of upright members, with each upright member extending in transverse relationship to the rails.

6. A barrier as defined in claim 5 in which a strengthening cable is installed in the internal region of the first rail, in overlying relationship to the lower leg of the clip.

7. A barrier comprising a system as defined in claim 1, further comprising:

at least one secondary rail disposed in spaced and parallel relationship to the first rail; and a plurality of upright members, with each upright member extending in transverse relationship to the rails.

8. A barrier as defined in claim 7 in which a strengthening cable is installed in the internal region of the first rail, in overlying relationship to the lower legs of the plural clips.

9. A system, comprising:

an elongate first rail having a pair of elongate edge portions defining the boundaries of a longitudinal gap, the first rail having an internal region defined by:

a lower section that includes one of the edge portions, comprising:

a side wall situated opposite the gap;

a lip disposed in spaced and opposed relationship to the side wall; and a base that interconnects the lip and the side wall; and an upper section that includes the other edge portion, comprising:

an upper wall that joins the side wall;

a plurality of clips disposed in longitudinally spaced relationship in the internal region of the first rail, each clip having opposed interior and exterior surfaces and comprising:

a lower leg;

an intermediate leg that adjoins the lower leg; and an upper leg that adjoins the intermediate leg, the upper leg having a transverse indentation formed in the exterior surface thereof; and an elongate conductive line, distinct from the first rail, extending within the internal region of the first rail;

in which the line traverses the indentation formed in each clip and in which each clip clamps the line against the upper wall of the first rail.

10. The system of claim 9 in which the clip is formed from a resilient material.

11. The system of claim 10 in which the interior surfaces of the intermediate and upper legs define an included angle greater than 90 degrees.

12. The system of claim 9 in which the lower leg is clearingly received between the side wall and the lip section, and disposed in a flush relationship to the base section.

13. The system of claim 9 in which the intermediate leg is disposed in a flush relationship to the side wall.

14. The system of claim 9 in which the upper leg is adapted to clamp a line traversing the upper indentation against the upper wall.

15. The system of claim 9 in which the width of the clip is less than the width of the gap formed in the first rail.

16. A barrier comprising the system of claim 9, further comprising:

at least one secondary rail disposed in spaced and parallel relationship to the first rail; and a plurality of upright members, with each upright member extending in transverse relationship to the rails.

17. A barrier as defined in claim 16 in which a strengthening cable is installed in the lower section of the first rail, in overlying relationship to the lower leg of the clip.

18. A barrier comprising a system as defined in claim 9, and further comprising:

at least one additional rail disposed in spaced and parallel relationship to the first rail; and a plurality of upright members, with each upright member extending in transverse relationship to the rails.

19. A barrier as defined in claim 18 in which a strengthening cable is installed in the lower section of the first rail, in overlying relationship to the lower legs of the plural clips.

20. A system, comprising:

an elongate rail extendable in substantially parallel relationship to a terrain, the rail having a planar base situated at its lower extremity, a pair of elongate edge portions defining the boundaries of a longitudinal gap, and an internal region accessible through the gap;

a plurality of clips installed in longitudinally spaced relationship within the internal region of the rail, each clip having an exterior surface situated adjacent the rail and an opposed interior surface, comprising:

a lower leg having an exterior surface in engagement with the base of the rail;

an intermediate section that adjoins the lower leg; and an upper section that adjoins the intermediate section, the upper section having a transverse indentation formed in an exterior surface thereof; and an elongate conductive line, distinct from the rail and extending within the internal region of the rail, the line traversing the indentation formed in each clip;

in which each clip clamps the line against an internal surface of the rail.

21. The system of claim 20, further comprising:

a strengthening cable extending longitudinally within the internal region of the rail in overlying relationship to the lower legs of the plural clips.

22. The system of claim 20 in which the rail is further characterized as having a side wall that adjoins the base, and in which the intermediate section comprises a leg having an exterior surface that engages the side wall of the rail.

* * * * *